US008256362B2

(12) United States Patent
Tajima et al.

(10) Patent No.: US 8,256,362 B2
(45) Date of Patent: Sep. 4, 2012

(54) EMBROIDERY SEWING MACHINE AND CONTROL METHOD THEREFOR

(75) Inventors: Ryo Tajima, Nagoya (JP); Shoji Kato, Nagoya (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 1125 days.

(21) Appl. No.: 12/134,512

(22) Filed: Jun. 6, 2008

(65) Prior Publication Data

US 2008/0302287 A1 Dec. 11, 2008

(30) Foreign Application Priority Data

Jun. 8, 2007 (JP) ..... 2007-152831

(51) Int. Cl.
*D05B 21/00* (2006.01)

(52) U.S. Cl. ..... 112/102.5; 112/99; 112/470.06; 112/157; 112/456

(58) Field of Classification Search ..... 112/99, 112/102.5, 139, 157, 453, 455, 456, 470.01, 112/470.06, 470.18; 700/136–138
See application file for complete search history.

(56) References Cited

U.S. PATENT DOCUMENTS 5,615,628 A * 4/1997 Tajima et al. ..... 112/157
7,290,493 B2 * 11/2007 Suzuki et al. ..... 112/220
2007/0101914 A1 * 5/2007 Suzuki et al. ..... 112/221
2007/0137540 A1 * 6/2007 Tajima et al. ..... 112/254
2007/0144417 A1 * 6/2007 Watanabe ..... 112/1
2007/0199490 A1 * 8/2007 Suzuki ..... 112/98
2007/0261621 A1 * 11/2007 Suzuki et al. ..... 112/220

FOREIGN PATENT DOCUMENTS

JP 8-299639 A 11/1996
JP 3145469 B2 1/2001
JP 3763863 B2 1/2006

* cited by examiner

*Primary Examiner* — Nathan Durham

(74) *Attorney, Agent, or Firm* — Rossi, Kimms & McDowell LLP

(57) ABSTRACT

First calculation section calculates, on the basis of sewing data, a sewing-progressing direction angle for rotating a rotary cylinder to orient an embroidering material, guided by a guide lever of a zigzag sewing head, in a sewing-progressing direction. Second calculation section adds or subtracts a zigzag-swinging angle to or from the sewing-progressing direction angle to thereby calculate a target rotational angle of the rotary cylinder. Swinging mechanism may be provided for swinging the guide lever relative to the rotary cylinder, and a swinging amount corresponding to the swinging angle of the rotary cylinder may be added to a width of zigzag-swinging by the swinging mechanism. Alternatively, every swinging movement necessary for zigzagging the embroidering material may be set by the swinging angle without the guide lever being caused to swing relative to the rotary cylinder.

5 Claims, 10 Drawing Sheets

EMBROIDERY SEWING MACHINE AND CONTROL METHOD THEREFOR

BACKGROUND

The present invention relates generally to embroidery sewing machines provided with a zigzag sewing head capable of supplying a string-shaped embroidering material, such as a tape or cord, to a needle drop position (i.e., stitching or sewing position) while zigzagging or swinging (or zigzag-swinging) the material leftward and rightward and then sewing the embroidering material onto a fabric or other sewing workpiece at the needle drop position.

Heretofore, there have been known embroidery sewing machines provided with a zigzag sewing head capable of supplying and sewing a string-shaped embroidering material while zigzag-swinging the embroidering material, such as a tape or cord, onto a fabric or other sewing workpiece, as disclosed in Japanese Patent Publication No. 3145469 or Japanese Patent Application Laid-open Publication No. HEI-8-299639. FIGS. 14 and 15A and 15B are views explanatory of a construction and behavior of the conventional zigzag sewing head provided in such embroidery sewing machines. The conventional zigzag sewing head includes: a vertically-driven needle bar (not shown) having a sewing needle attached thereto; a rotary cylinder 100 disposed around and concentrically with the needle bar for rotation about the axis of the needle bar; and a guide lever 101 pivotably mounted relative to the rotary cylinder 100 via a lever pin 102 for guiding a string-shaped embroidering material T to a needle drop (stitching or sewing) position of the sewing needle. In FIGS. 14 and 15A and 15B, reference character P indicates the current needle drop (stitching) position, Pa the last preceding stitching position, Pb the second stitching position backward from the current stitching position P, and T the string-shaped embroidering material.

In the embroidery sewing machines provided with such a zigzag sewing head, a sewing-progressing direction relative to a fabric (i.e., direction indicated by a black arrow in the figure) is calculated on the basis of predetermined sewing data. Then, sewing operation is carried out, in accordance with the calculated sewing-progressing direction, while rotation of the rotary cylinder is being controlled so that the lever pin 102 is always located straight ahead in the sewing-progressing direction. Further, during that time, the embroidering material T is supplied to and sewn onto a fabric while being zigzag-swung leftward and rightward of the sewing-progressing direction the lever pin 102 in a predetermined pattern through reciprocative swinging movement of the guide lever 101 with the lever pin 102 functioning as a fulcrum point.

With the aforementioned conventional zigzag sewing head, the rotational direction and rotational angle of the rotary cylinder is controlled such that the lever pin 102 is always located straight ahead in the sewing-progressing direction during the sewing operation. Zigzag-swinging movement of the embroidering material T is effected only by swinging movement of the guide lever 101. Consequently, amounts of zigzag-swinging of the embroidering material T depend on an arm length of the guide lever 101 (i.e., length from the lever pin 102 to the lower end of the guide lever 101), and thus, there is encountered a limit in increasing the leftward and rightward zigzag-swinging movement of the embroidering material T. Therefore, in a case where the string-shaped embroidering material T comprises a string and ornaments or accessories attached to the string, such as a beaded string (i.e., string passed through a plurality of beads B), and the embroidering material T has a relatively great diameter, the zigzagged embroidering material T and the sewing needle T may undesirably contact each other, so that the beads B (or ornaments or accessories) and/or the sewing needle may be broken. Such an inconvenience may occur not only with a string-shaped embroidering material T having ornaments or accessories, such as a beaded string, but also with a string-shaped embroidering material T having a great thickness or width.

With the conventional zigzag sewing head shown in FIGS. 15A and 15B, an embroidery frame (not shown) holding the fabric is horizontally moved, in synchronism with swinging movement of the guide lever 101, by an amount of movement calculated by adding a predetermined amount of movement, in the swinging direction of the guide lever 101, to an original amount of stitching movement of the embroidery frame, in order to avoid unwanted contact between the string-shaped embroidering material T and the sewing needle. Namely, as shown in FIG. 15A, when the guide lever 101 should swing rightward (downward in the figure) with respect to the sewing-progressing direction, the embroidery frame too is moved rightward by an amount calculated by adding a predetermined amount to an original amount of stitching movement. Further, as shown in FIG. 15B, when the guide lever 101 should swing leftward (upward in the figure) with respect to the sewing-progressing direction, the embroidery frame too is moved leftward by an amount calculated by adding a predetermined amount to an original amount of stitching movement. With such arrangements, the string-shaped embroidering material T, having already been sewn to the fabric with one or more previous stitches is caused to swing leftward and rightward in response to the movement of the embroidery frame, and thus, the embroidering material T moves greatly away from the needle drop position P. Therefore, even where the embroidering material T has a relatively great diameter, it is possible to prevent unwanted contact between the embroidering material T and the sewing needle. Also, Japanese Patent Publication No. 3763863 discloses a sewing machine which automatically generates zigzag-sewing movement data of the embroidery frame.

FIGS. 16A and 16B show an embroidering material T sewn on a fabric by means of the zigzag sewing head that performs zigzag sewing operation based only on the swinging movement of the guide lever 101, and FIGS. 17A and 17B show an embroidering material T sewn on a fabric by means of the zigzag sewing head that performs zigzag sewing operation based on a combination of the swinging movement of the guide lever 101 and movement of the embroidery frame. More specifically, FIGS. 16A and 17A are each a plan view of the fabric having the embroidering material T sewn thereon, and FIGS. 16B and 17B are perspective views corresponding to the plan views. As seen from the figures, with the zigzag sewing operation based only on the swinging movement of the guide lever 101 involving no movement of the embroidery frame, stitched positions PP are hidden under the embroidering material T, when viewed from above, because the embroidering material T is located right over the stitches. With the zigzag sewing operation based on the combination of the swinging movement of the guide lever 101 and movement of the embroidery frame, on the other hand, stitched positions PP are exposed at opposite sides of the embroidering material T, when viewed from above, because the embroidering material T is located between stitches zigzagged with respect to the sewing-progressing direction. Namely, the zigzag sewing operation based on the combination of the swinging movement of the guide lever 101 and movement of the embroidery frame would require a different sewing design of the embroidering material T from that required of the zigzag sewing operation based only on the swinging movement of the guide lever 101 involving no movement of the embroidery frame.

Further, there have hereto been known so-called "combination embroidery sewing machines" which perform combination embroidery using a pair of a zigzag sewing head and another type of machine head capable performing other sewing operation, such as multi-color embroidery.

Generally, in combination embroidery sewing machines comprising pairs of zigzag sewing heads and multi-color embroidering heads, embroidery frames are provided beneath and in corresponding relation to the pairs of zigzag sewing heads and multi-color embroidering heads. In performing a combination of zigzag sewing and multi-color embroidery sewing onto a sewing workpiece (fabric), for example, "needle-to-needle movement" has to be performed between the zigzag sewing head and the multi-color embroidering head; such needle-to-needle movement is effected by horizontal movement of the embroidery frame. Further, in order to avoid a lower end portion of the guide lever 101, located near the needle drop position, from interfering with the embroidery frame during the horizontal movement of the embroidery frame, the guide lever 101 is manually caused to swing so that the lower end portion of the guide lever 101 is evacuated, prior to the horizontal movement of the embroidery frame, upwardly away from a range of the movement of the embroidery frame. However, if a human operator forgets to evacuate the guide lever 101 prior to the horizontal movement of the embroidery frame, the embroidery frame may interfere with and damage the guide lever 101.

SUMMARY OF THE INVENTION

In view of the foregoing, it is an object of the present invention to provide an improved embroidery sewing machine and control method therefor which, even where an embroidering material to be sewn onto a sewing workpiece has a relatively great diameter, thickness or width, can reliably prevent a zigzagged embroidering material from contacting a sewing needle during a sewing operation without changing a sewing design of the embroidering material.

It is another object of the present invention to provide an improved embroidery sewing machine and control method therefor which can reliably prevent inconveniences, such as damage to an embroidering-material guide section of a zigzag sewing head, even when an embroidery frame has interfered with the guide section due to a human operator's failure to evacuate the guide section prior to needle-to-needle movement between the zigzag sewing head and another type of machine head.

In order to accomplish the above-mentioned objects, the present invention provides an improved embroidery sewing machine, which comprises: a zigzag sewing head including: a needle bar reciprocatively drivable with a sewing needle attached thereto; a rotary member provided around an outer periphery of the needle bar for rotation about an axis of the needle bar; and a guide section for guiding a string-shaped embroidering material to a sewing position; a first calculation section for calculating, on the basis of sewing data, a sewing-progressing direction angle for rotating the rotary member to orient the embroidering material, guided by the guide section, in a sewing-progressing direction; and a second calculation section for adding or subtracting a zigzag-swinging angle to or from the sewing-progressing direction angle, calculated by the first calculation section, to thereby calculate a target rotational angle of the rotary member. The rotary member is rotated in accordance with the target rotational angle calculated by the second calculation section.

The first calculation section, which is in the form of a conventionally known means for performing control to orient a string-shaped embroidering material in a sewing-progressing direction, calculates, on the basis of sewing data, a sewing-progressing direction angle for rotating the rotary member to orient the embroidering material, guided by the guide section, in a sewing-progressing direction. The present invention is characterized by inclusion of the novel second calculation section, which adds or subtracts a zigzag-swinging angle to or from the sewing-progressing direction angle, calculated by the first calculation section, to thereby calculate a target rotational angle of the rotary member. The rotary member is rotated in accordance with the target rotational angle calculated by the second calculation section. Thus, the rotational angle of the rotary member itself engages in zigzagging of the embroidering material, and the guide section can be set so that the zigzag-swinging angle increases. Thus, even where the embroidering material to be sewn has a relatively large diameter, the present invention can effectively prevent the zigzagged embroidering material and the sewing needle from contacting each other. Further, because the present invention can increase a zigzag-swinging amount of the embroidering material without moving the embroidery frame leftward and rightward of the sewing-progressing direction done in the prior art machine, the present invention can prevent stitches from zigzagging with respect to the sewing-progressing direction and effectively prevent the sewing design from differing as in the case where the embroidery frame is moved so as to avoid contact between the embroidering material and the sewing needle.

In one embodiment, the zigzag sewing head further includes a swinging mechanism for swinging the guide section relative to the rotary member to thereby zigzag-swing the embroidering material, guided by the guide section, leftward and rightward of the sewing-progressing direction, and a swinging amount corresponding to the swinging angle of the rotary member is added to a width of zigzag-swinging, by the swinging mechanism, of the guide section. Thus, the swinging angle provided through driving of the rotary member is added to the conventionally-known zigzagging movement of the guide section, and thus there can be provided a structural arrangement suited for zigzag sewing that requires great swinging of the embroidering material Further, because the guide section itself rotates integrally with the rotary member about the axis of the needle bar so that the swinging angle is added to the swinging width based on linear swinging movement of the guide section, the guide section can approach the last stitched position, by an amount corresponding to the swinging angle, than in the case where the zigzagging of the same swinging width is effected only though the linear swinging movement of the guide section. As a consequence, it is possible to prevent a superfluous length of the embroidering material from being paid out per zigzagging movement, so that the embroidering material can be sewn onto a sewing workpiece with no slack. In this way, the present invention allows the embroidering material to be sewn with a greatly improved finish.

Further, even where an embroidering material of a great diameter is to be sewn, the present invention only requires a rotational direction and angle of the rotary member, instructed by sewing data, to be changed only through an angle corresponding to a swinging angle in the swinging direction of the guide section, without changing the sewing data. Thus, the present invention can control the sewing operation by the zigzag sewing head with an utmost ease.

In one embodiment, every swinging movement necessary for the embroidering material, guided by the guide section, to be zigzag-swung leftward and rightward of the sewing-progressing direction may be set by the swinging angle added or subtracted by the second calculation section. Because this arrangement permits zigzagging of the embroidering material through control of the rotational angle of the rotary member, the present invention requires no particular mechanism and drive source for swinging the guide lever to zigzag-swing the embroidering material. Further, because the zigzagging is effected only by rotating the guide section about the axis of the needle bar together with the rotary member, the guide section can approach the last stitched position as compared to the zigzagging via a swinging mechanism of the guide section which is constructed to linearly swing at right angles with the sewing-progressing direction. Thus, it is possible to prevent a superfluous length of the embroidering material from being paid out per zigzagging movement, so that the embroidering material can be sewn onto the fabric with no slack. In this way, the present invention can achieve the advantageous result that the embroidering material can be sewn with a greatly improved finish.

In one embodiment, the embroidery sewing machine of the present invention further comprises another machine head provided in combination with the zigzag sewing head, and it is applicable to a combination embroidery sewing machine in which the head to be used for sewing onto the sewing workpiece is switchable between the zigzag sewing head and the other machine head by the embroidery frame, holding the sewing workpiece, moving so as to be operatively associated with a desired one of the zigzag sewing head and the other machine head. In this case, the present invention is arranged to avoid inconveniences, such as a damage to the guide section during needle-to-needle movement of the embroidery frame, by appropriately performing rotational positioning control of the rotary member in the zigzag sewing head.

For that purpose, the guide section of the zigzag sewing head is movable between a sewing operation position where the guide section enters a moving area of the embroidery frame and an evacuated position upwardly away from the moving area of the embroidery frame, and the guide section includes a locking member for locking the guide section in the sewing operation position. When the embroidery frame is to be subjected to needle-to-needle movement between the zigzag sewing head and the other machine head, the rotary cylinder is positioned at a predetermined rotational angle such that, as the embroidery frame moves to abut against and press the guide section, the locking by the locking member is canceled to allow the guide section to move to the evacuated position.

When the embroidery frame is to be subjected to the needle-to-needle movement between the zigzag sewing head and the other machine head in the combination embroidery sewing machine, the aforementioned arrangement positions the rotary cylinder at a predetermined rotational angle such that, as the moving embroidery abuts against and presses the guide section, the locking by the locking member is automatically canceled. Thus, even when the human operator forgot to perform the manual operation for moving the guide section to the evacuated position prior to moving the embroidery frame and thus the embroidery frame has interfered with the guide section, the locking by the locking member can be automatically canceled. Consequently, as the embroidery frame further moves to press the guide section, the guide section is automatically moved toward the evacuated position, with the result that the present invention can reliably avoid inconveniences, such as a damage to the guide section.

Namely, even where the embroidering material to be sewn onto a sewing workpiece through zigzag sewing operation has a relatively large diameter, the present invention can effectively prevent the zigzagged embroidering material from contacting the sewing needle. Further, even when the human operator forgot to perform the manual operation for moving the guide section to the evacuated position prior to moving the embroidery frame for needle-to-needle movement between the zigzag sewing head and the other machine head and thus the embroidery frame has interfered with the guide section, the present invention can reliably avoid inconveniences, such as a damage to the guide section.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION

In the following description, the term "left" is used to means a left side as viewed from the front of a later-detailed zigzag sewing head H, while the term "right" is used to means a right side as viewed from the front of the zigzag sewing head H.

First Embodiment

Figure 1:
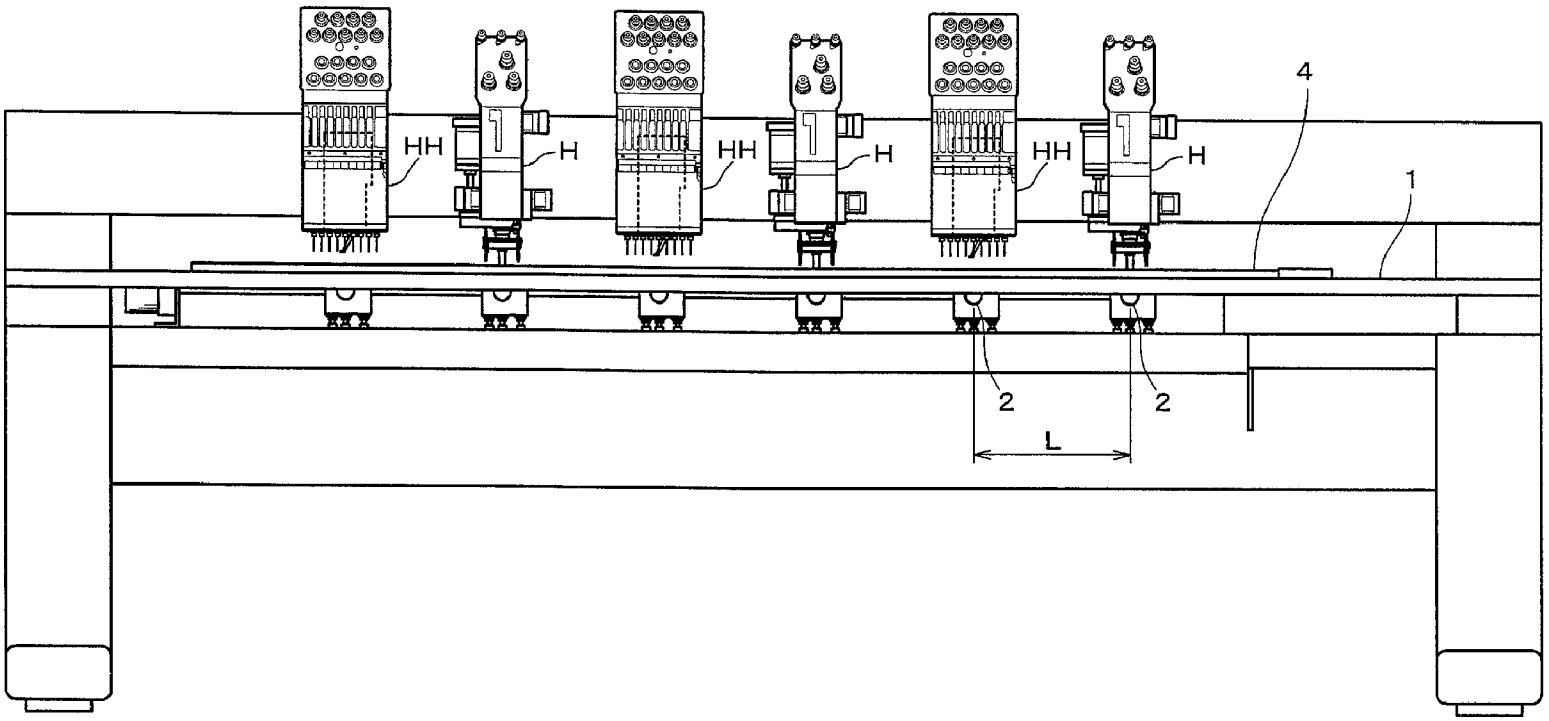
FIG. 1 is a front view of an embroidery sewing machine provided with zigzag sewing heads according to a first embodiment of the present invention.
Figure 2:
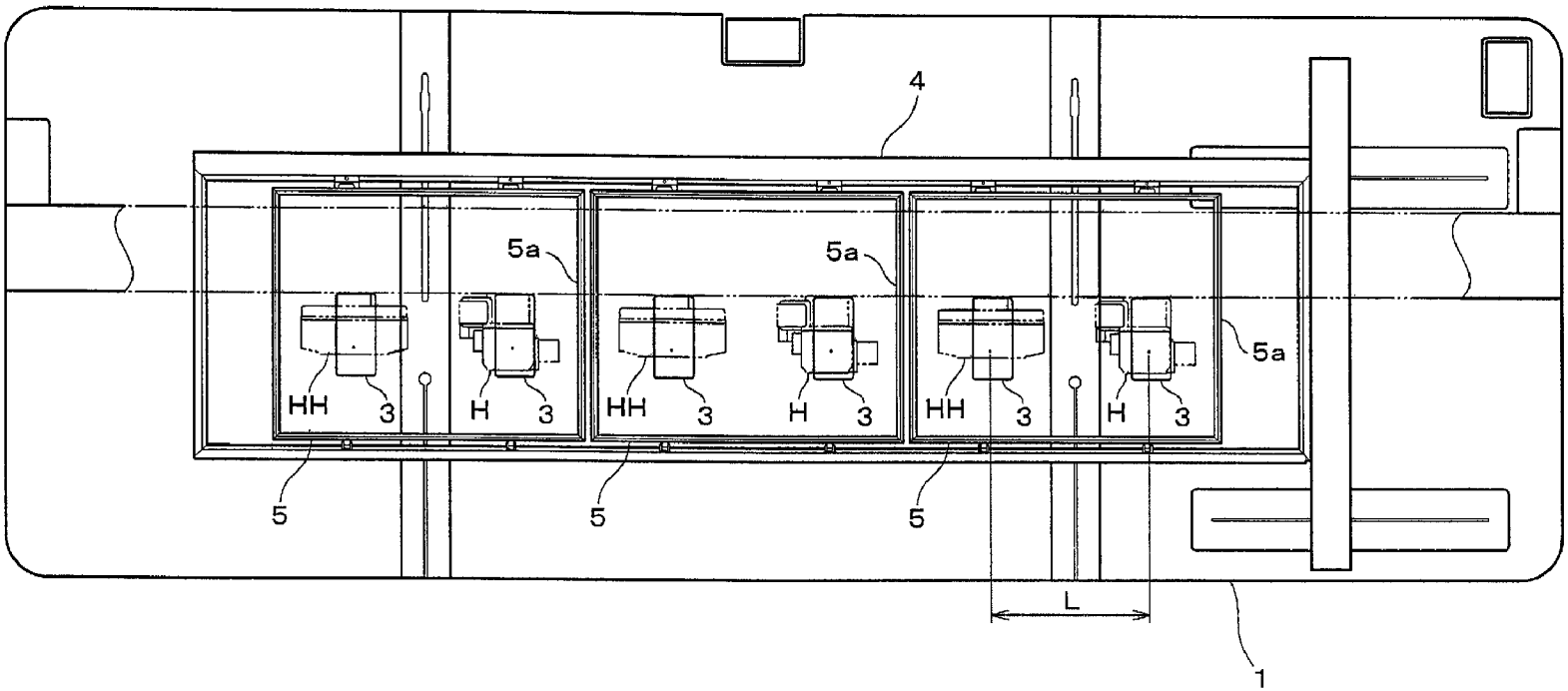
FIG. 2 is a plan view of the embroidery sewing machine provided with the zigzag sewing heads according to the first embodiment of the present invention.

FIGS. 1 and 2 are a front view and plan view, respectively, of a multi-head combination embroidery sewing machine (hereinafter referred to simply as "embroidery sewing machine") with zigzag sewing heads according to a first embodiment of the present invention. As shown, the embroidery sewing machine comprises: the zigzag sewing heads H disposed over a machine table 1 and capable of performing zigzag sewing; conventional multi-color embroidering heads HH capable of multi-color embroidering by sewing while selecting among a plurality of color threads; rotary hooks 2 each supported on a rotary hook base; and needle plates 3 each fixed to the upper surface of a corresponding one of the rotary hook base. The zigzag sewing heads H and the multi-color embroidering heads HH are disposed adjacent to each other so as to provide pairs of the zigzag sewing heads H and multi-color embroidering heads HH. In the illustrated example, the embroidery sewing machine is provided with three pairs of the zigzag sewing heads H and multi-color embroidering heads HH, via each of which it can perform combination embroidery comprising a combination of decorative embroidery of an embroidering material with the zigzag sewing head H and ordinary multi-color embroidery with the multi-color embroidering head HH.

Base frame 4 is disposed on the upper surface of the machine table 1 and drivable, via a not-shown drive mechanism disposed under the machine table 1, to move in X- and Y-axis directions in a horizontal plane. Embroidery frames 5, each for holding a sewing workpiece, such as a fabric, in a stretched taut condition, are installed in the base frame 4. The embroidery frames 5 are provided in corresponding relation to, and under, the pairs of the zigzag sewing heads H and multi-color embroidering heads HH. In performing the combination embroidery, this embroidery sewing machine activates the zigzag sewing head H and multi-color embroidering head HH of each of the pairs in turn. To switch the activation between the zigzag sewing head H and multi-color embroidering head HH, the embroidery frame 5 holding the sewing workpiece in a stretched taut condition is moved horizontally by an amount corresponding to a distance L between needles of the two heads H and HH ("needle-to-needle movement"). Each of the multi-color embroidering heads HH may be in the form of a conventionally-known embroidery head, and thus, a detailed description about a construction and behavior of the multi-color embroidering head HH is omitted here.

Figure 3:
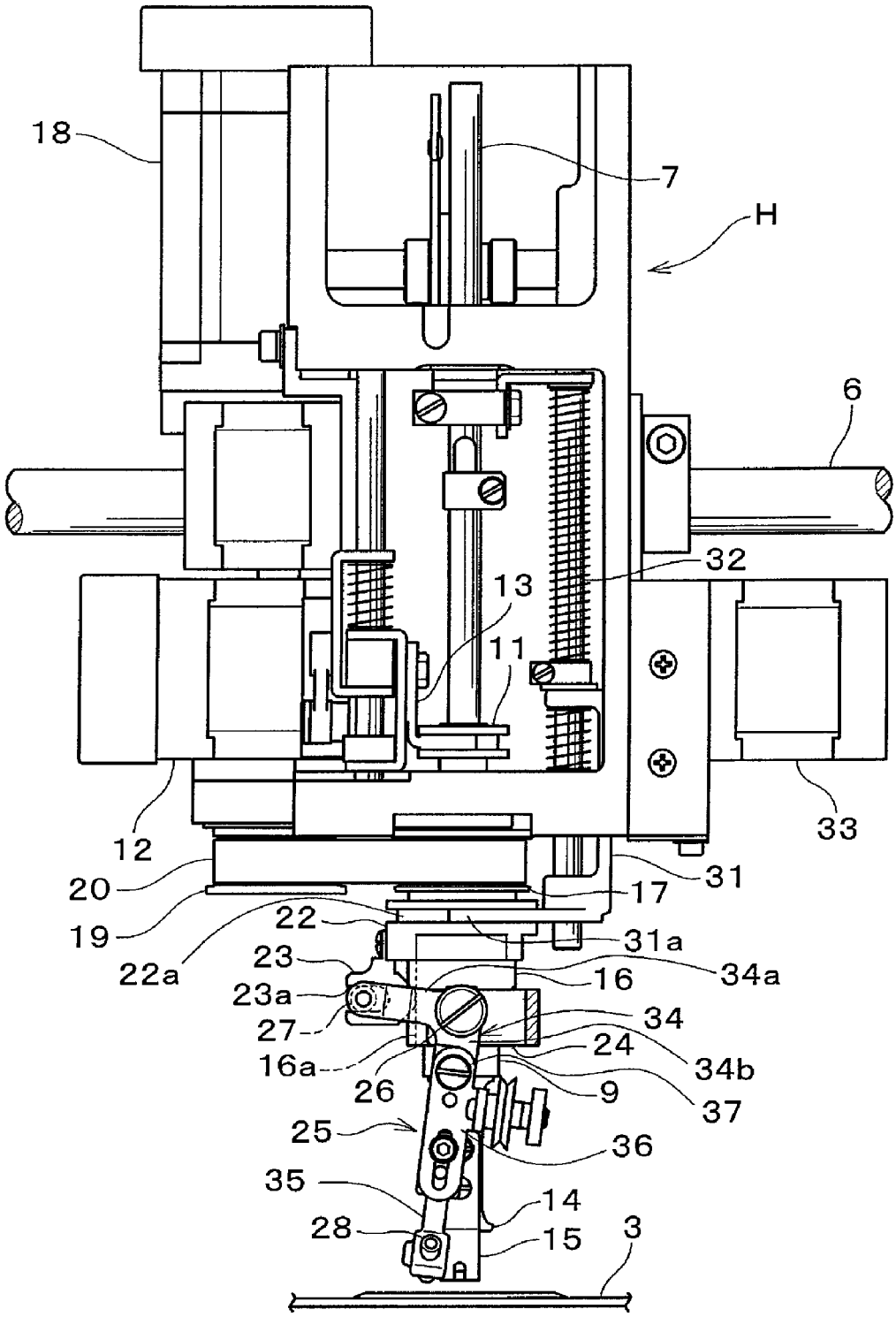
FIG. 3 is a front view of the zigzag sewing head.
Figure 4:
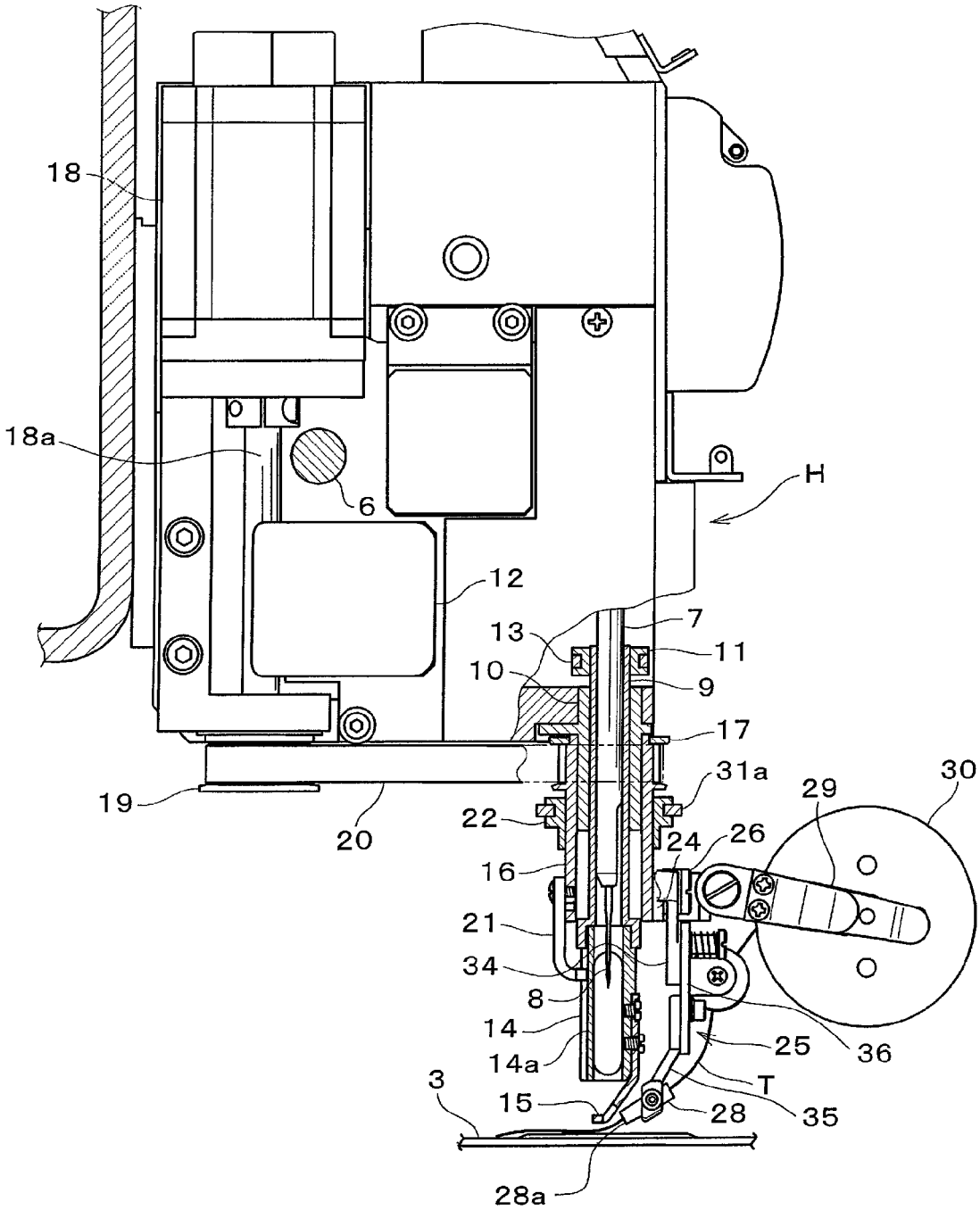
FIG. 4 is a partly-sectional side view of the zigzag sewing head.

FIGS. 3 and 4 are a front view and partly-sectional side view, respectively, of the zigzag sewing head H. The zigzag sewing head H includes a needle bar 7 having a longitudinal axis extending in an up-down (i.e., vertical) direction. The needle bar 7 is reciprocatively movable through rotation of a main machine shaft 6. Sewing needle 8 is attached to a lower end portion of the needle bar 7. Supporting cylinder 9 is provided around the outer periphery of the needle bar 7 in such a manner that it is not only vertically movable relative to the needle bar 7 but also rotatable about the axis of the needle bar 7 while being guided by the inner peripheral surface of a sleeve 10 fixed to a lower portion of the zigzag sewing head H. Engagement ring 11 is fixed to the outer periphery of an upper end portion of the supporting cylinder 9, and a driving arm 13 vertically movable by being driven by a motor 12 is held in engagement with the engagement ring 11. Fabric holder support member 14 is fixed to a lower end portion of the supporting cylinder 9. The fabric holder support member 14 has a bifurcated lower end section with opposed leg portions, and one of the opposed leg portions has a vertically-elongated key groove 14*a* in the outer surface thereof while the other of the opposed leg portions has a fabric holder 15 fixed thereto.

Rotary cylinder (rotary member) 16 is attached to the outer peripheral surface of the fixed sleeve 10 in concentric relation to the needle bar 7, and the rotary cylinder 16 is only rotatable about the axis of the needle bar 7. Timing pulley portion 17 is formed on the outer periphery of an upper end portion of the rotary cylinder 16, and a timing pulley 20 extends between, and is wound at its opposite end portions on, the timing pulley portion 17 and a driving pulley 19 fixed to a rotation shaft 18*a* of a motor 18. Thus, as the driving pulley 19 rotates by being driven by the motor 18, the rotation of the driving pulley 19 is transmitted to the cylinder 16, so that the cylinder 16 rotates. Further, the rotary cylinder 16 has a key member 21 fixed to its lower end and engageable with the key groove 14*a* of the fabric holder support member 14. Thus, the fabric holder 15 not only vertically moves in response to vertical movement of the supporting cylinder 9, but also rotates about the axis of the needle bar 7 in response to rotation of the rotary cylinder 16.

Interlocking member 22 is provided on and around the outer periphery of the rotary cylinder 16. Connecting piece 23 is fixed to the interlocking member 22 and engaged in an engaging groove 16*a* formed in the outer periphery of the connecting piece 23. Thus, as the rotary cylinder 16 rotates, the interlocking member 22 rotates integrally with the rotary cylinder 16. Further, a guide lever (guide section) 25 is connected via a bracket 24 to the rotary cylinder 16, and this guide lever 25 is pivotable about a lever pin 26, fixed to the outer peripheral surface of the bracket 24, so that it can swing relative to the rotary cylinder 16 laterally leftward and rightward of the axis of the needle bar 7.

The guide lever 25 includes a base member 34 of a substantial L shape having one arm portion 34*a* extending laterally away from the lever pin 26 and another arm portion 34*b* extending downwardly away from the lever pin 26, and a guide member 35 connected to the lower end of the arm portion 34*b* of the base member 34. As will be later described, the guide member 35 is vertically pivotably connected to the arm portion 34*b* of the base member 34 via a guide pin 37 and connecting member 36. Guide cylinder 28 for supplying an embroidering material T to the needle drop position (stitching or sewing position) of the sewing needle 8 is attached to the lower end of the guide member 35. Lower end portion of the guide cylinder 28 is constructed as an embroidering material supply or lead-out port 28*a*.

Roller 27 is mounted at the distal end of the arm portion 34*a* of the base member 34, and the arm portion 34*a* is engaged in a link groove 23*a* of the connecting piece 23 via the roller 27. Further, as shown in FIG. 4, a bobbin bracket 29 is fixed to the outer periphery of the rotary cylinder 16, and a bobbin 30 having a string-shaped sewing material T wound thereon is rotatably supported on the bobbin bracket 29.

As shown in FIG. 3, a guide shaft 32 oriented so that its axis extends in the up-down (vertical) direction is disposed adjacent to the needle bar 7. Elevator member 31 is connected to the guide shaft 32. Driving force produced by rotation of a zigzagging motor 33 is transmitted to the elevator member 31 via a not-shown driving force transmission mechanism, so that the elevator member 31 is movable vertically in the axial direction thereof while being guided by the guide shaft 32. The elevator member 31 has a fork portion 31*a* projecting substantially horizontally toward the needle bar 7, and this fork portion 31*a* is held in engagement with a groove portion 22*a* formed in the outer periphery of the interlocking member 22. Thus, the interlocking member 22 and connecting piece 23 move vertically in response to vertical movement of the elevator member 31, and the vertical movement of the connecting piece 23 is converted into swinging movement of the guide lever 25 via the link groove 23*a* and roller 27. In this manner, the guide cylinder 28 fixed at the lower end of the guide lever 25 can reciprocatively swing linearly leftward and rightward, with the lever pin 26 as a fulcrum point, with respect to a sewing-progressing direction.

Figure 5:
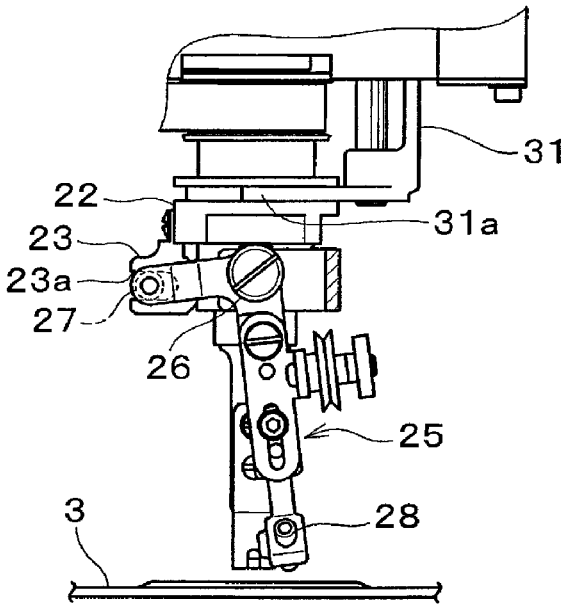
FIG. 5 is a fragmentary enlarged front view of a lower section of the zigzag sewing head, which particularly shows an elevator member having moved to a lower limit position and a guide lever having swung to a rightmost swung position.

FIG. 3 shows the elevator member 31 in its upper limit position and the guide lever 25 in its leftmost swung position. FIG. 5 is a fragmentary enlarged front view of a lower section of the zigzag sewing head H, which particularly shows the elevator member 31 in its lower limit position and the guide lever 25 in its rightmost swung position. The guide cylinder 28 fixed at the lower end of the guide lever 25 is reciprocatively movable leftward and rightward between the positions shown in FIGS. 3 and 5, in synchronism with reciprocative vertical movement of the needle bar 7. Thus, the embroidering material T supplied through the lead-out port 28*a* provided at the distal end of the guide cylinder 28 is fed to the needle drop position while being zigzagged leftward and rightward with respect to the sewing progression direction, so that the embroidering material T is sequentially sewn onto the fabric.

Figure 6A:
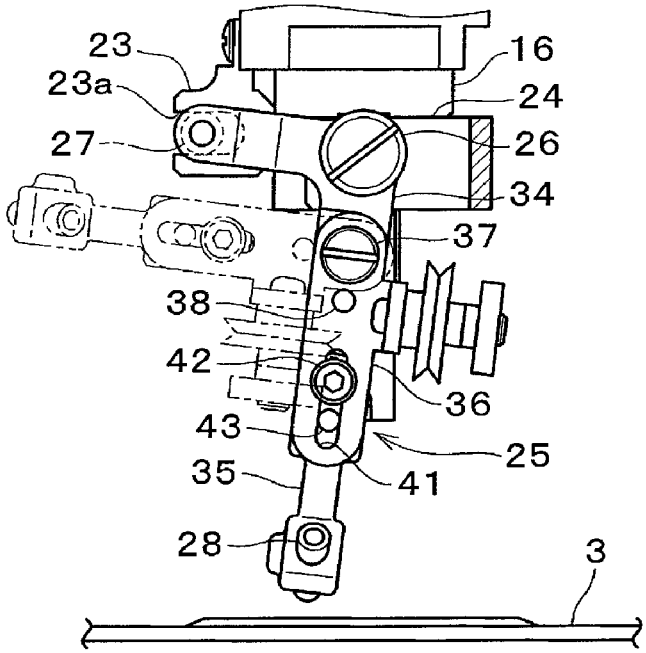
FIG. 6A is a fragmentary enlarged front view of a lower section of the zigzag sewing head.
Figure 6B:
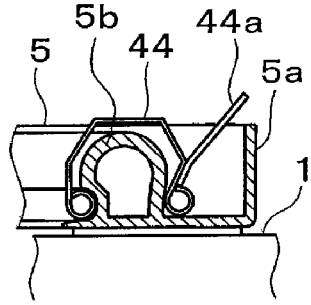
FIG. 6B is a sectional view of a vertical side portion of an embroidery frame.
Figure 7:
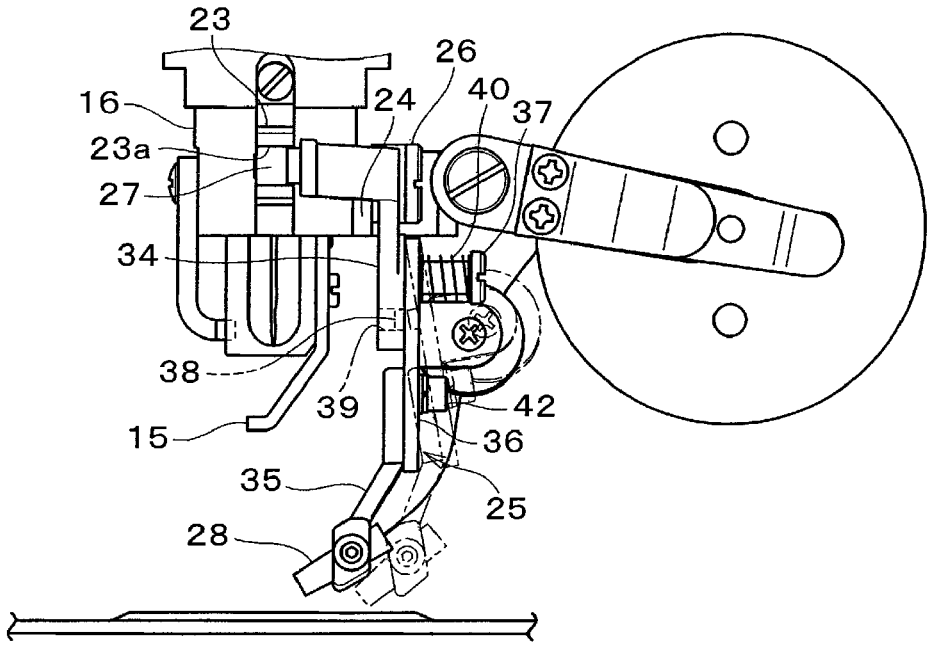
FIG. 7 is a fragmentary enlarged side view of a lower section of the zigzag sewing head.

FIG. 6A is a fragmentary enlarged front view of a lower section of the zigzag sewing head H, and FIG. 6B is a sectional view of a vertical side portion 5*a* of the embroidery frame 5. Further, FIG. 7 is a fragmentary left side view of a lower section of the zigzag sewing head H. As shown in FIGS. 6A and 7, a connection member 35 interconnecting the base member 34 and the guide member 35 is mounted via the guide pin 37 to an outer surface of the base member 34. The guide pin 37 is mounted so that its axis extends horizontally outward from the axis of the needle bar 7. Further, the connection member 36 is movable relative to the base member 34 and in parallel to the axis of the guide pin 37 and pivotable about the axis of the guide pin 37. Further, a coil spring 40, which is disposed around the outer periphery of the guide pin 37, resiliently abuts at its opposite ends against the connection member 34 and the head of the connection pin 37. The connection member 36 is pressed against the outer side surface of the base member 34 by the resilient urging force of the coil spring 40. The connection member 36 has a projecting engagement pin 38 formed on a surface thereof facing the base member 34, and the base member 34 has an engaging hole 39 formed in a surface thereof facing the connection member 36 so that the engagement pin 38 is engageable in the engaging hole 39. These engagement pin 38 and engaging hole 39 together constitute a mechanism for locking the guide member 35 in the sewing (operation) position.

Vertically elongated hole 41 is formed in the connection member 36 near its lower end, and a fastening screw 42 for fastening the guide member 35 is mounted in the vertically elongated hole 41. Further, a projecting pin 43 formed on the guide member 35 is inserted in the vertically elongated hole 41, so that the guide member 35 can be positionally fixed by being finely adjusted in its vertical position along the longitudinal direction of the elongated hole 41.

In response to manual operation by the human operator, the guide lever 25 is movable (positionally switchable) between a sewing operation position where it can engage in zigzag sewing operation as indicated in solid lines in FIG. 6A and an evacuated position indicated in imaginary lines in FIG. 6A. While the guide lever 25 is in the sewing operation position, the engagement pin 38 of the connection member 36 is held in engagement in the engaging hole 39 of the base member 34, and the connection member 36 is held locked relative to the base member 34. The engagement pin 38 and engaging hole 39 function as locking members in the sewing operation position. To move the guide lever 25 upwardly from the sewing operation position to the evacuated position, first, the connection member 36 is moved away from the base member 34 against the biasing force of the coil spring 40 as indicated in imaginary lines in FIG. 7, to thereby disengage the engagement pin 38 from the engaging hole 39 (i.e., cancel the locking by the locking members). Then, the connection member 36 and guide member 35 are caused to together pivot about the guide pin 37 upwardly and leftwardly so that the guide lever 25 is moved to the evacuated position shown in imaginary lines in FIG. 6A.

As shown in FIG. 6B, the embroidery frame 5 has an upwardly-projecting ridge 5*b* formed thereon inwardly of the vertical frame side portion 5*a* and extending along the vertical frame side portion 5*a*. Retaining clip 44 for retaining the sewing workpiece (fabric) on the ridge 5*b* can be fitted over the ridge 5*b*. The lower end of the guide lever 25 provided on the zigzag sewing head H has a lower height than the vertical frame side portion 5*a*. Thus, if the guide lever 25 is kept in the sewing operation position, the vertical frame side portion 5*a* or retaining clip 44 would undesirably collide with the guide lever 25 as the embroidery frame 5 passes under the zigzag sewing head H. Thus, in order to avoid such a collision, it has been conventional for a human operator to set the guide lever 25 in the evacuated position through manual operation, before moving the embroidery frame 5 to change the operating head between the zigzag sewing head H and the multicolor embroidery head HH. However, if the human operator forgets to manually set the guide lever 25 in the evacuated position in advance, the above-mentioned unwanted collision would occur. Thus, the present invention is arranged to avoid such an inconvenience even when the human operator has forgotten to manually set the guide lever 25 in the evacuated position. To facilitate attachment and detachment of the embroidery frame 5, operation for evacuating the guide member 35 is also performed when the fabric is to be replaced after completion of the embroidery operation. Upon completion of the zigzag sewing, the fabric holder 15 is automatically evacuated to a predetermined evacuated position higher than a top dead center of the sewing operation, as shown in FIG. 7, through activation of the motor 12; thus, no inconvenience, such as a collision with the guide lever 25, would not occur.

When the embroidering material T is to be sewn with the zigzag sewing head H constructed in the aforementioned manner, first, the bobbin 30 having the embroidering material T wound thereon is set on the bobbin bracket 29, and then, a leading end portion of the embroidering material T is paid out from the bobbin 30, passed through the guide cylinder 28 and directed through the lead-out port 28*a* to the drop position of the sewing needle 8. In such a condition, not only the base frame 4 (and hence the embroidery frame 5) is moved in the X and Y directions in a controlled manner on the basis of predetermined sewing data, but also the needle bar 7 is reciprocatively driven up and down so as to perform sewing operation in the well-known manner by means of the needle bar 8 and rotary hook 2. Note that, in the present invention, the amount of the movement, in the X and Y directions, of the embroidery frame 5 based on the sewing data engages in only formation of original desired stitches and does not engage in zigzag sewing. Also note that the fabric holder 15 is vertically movable, by being driven by the motor 12, at predetermined timing relative to the up-down movement of the needle bar 7 to thereby perform the fabric holding function.

For the zigzag sewing by the zigzag sewing head H employed in the instant embodiment, a rotational angle of the rotary cylinder 16 is calculated and set, per stitch, by adding or subtracting a zigzag-swinging angle to or from an original rotational angle of the rotary cylinder 16 for directing the embroidering material T in a desired sewing-progressing direction, and the rotation of the rotary cylinder 16 is controlled so that the rotary cylinder 16 is positioned at the thus-set rotational angle. At that time, the guide lever 25 too is linearly swung leftward or rightward per stitch for zigzag sewing, just as in the conventional techniques. Thus, per-stitch, zigzag-sewing swinging movement comprises a sum of the linear swinging width of the guide lever 25 and a swinging amount corresponding to the zigzag-swinging angle of the rotary cylinder 16. Specifically, the rotational angle for directing the embroidering material T in the sewing-progressing direction is an absolute rotational angle for controlling the lever pin 26, fixed to the rotary cylinder 16, to be positioned straight ahead in the sewing-progressing direction of the zigzag sewing head H. The zigzag sewing swinging angle of the rotary cylinder 16 is, on the other hand, is a relative variation value to the above-mentioned rotational angle for directing the embroidering material T in the sewing-progressing direction. The positive/negative sign of the swinging angle of the rotary cylinder 16 depends on the swinging direction of the guide lever 25 for the switch in question. Further, the value of the swinging angle of the rotary cylinder 16 is determined taking into account characteristics of the embroidering material T (such as a size of beads and thickness of the string). If the zigzag sewing can be performed with no problem by only setting the swinging width of the guide lever 25, then the swinging angle of the rotary cylinder 16 may be "0". If, on the other hand, the swinging width of the guide lever 25 is insufficient for the zigzag sewing, the swinging angle of the rotary cylinder 16 is set at a suitable value. Such a value of the swinging angle of the rotary cylinder 16 may be either a predetermined value preset in the embroidery sewing machine, or a value set manually set by the human operator via a setting means, such as an operation panel. Alternatively, the swinging angle of the rotary cylinder 16 may be of a value calculated in accordance with the rotational angle of the rotary cylinder 16. In another alternative, a suitable value of the swinging angle of the rotary cylinder 16 may be selected from among a plurality of swinging angle values, in accordance with the thickness and/or the like of the embroidering material T to be sewn.

Figure 8:
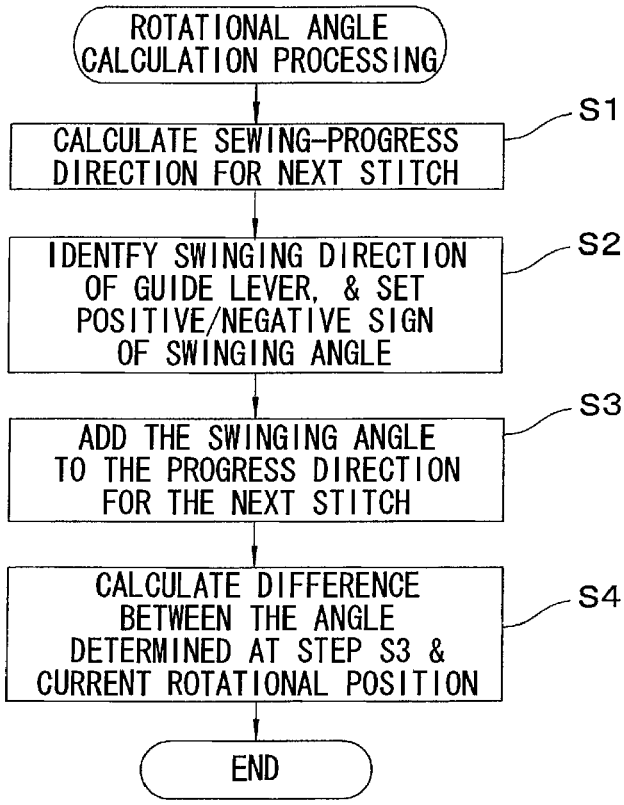
FIG. 8 is a flow chart showing an example operational sequence of processing for calculating a rotational direction and rotational angle of the rotary cylinder.

A further detailed description will be given about the control of the rotational direction and rotational angle of the rotary cylinder 16. FIG. 8 is a flow chart showing an example operational sequence of rotational angle calculation processing for calculating a rotational angle of the rotary cylinder 16 through which to rotate the cylinder 16; the processing is performed per stitch. Computer program of this rotational angle calculation processing is prestored in a computer-readable storage medium (not shown) provided in the embroidery sewing machine, and the rotational angle calculation processing is performed by a computer executing the prestored program. First, at step S1 of the rotational angle calculation processing, a calculation process corresponding to a "first calculation means or section" is performed for calculating a sewing-progressing direction angle, on the basis of X- and Y-direction position data of a next stitch based on predetermined sewing data, for rotating the cylinder 16 to orient the embroidering material T, guided by the guide lever (guide section) 25, in a desired sewing-progressing direction corresponding to the next stitch. In the case of the zigzag sewing head H employed in the instant embodiment, the initial rotational position of the rotary cylinder 16 is set such that the lever pin 26 is located to the right of the head H as viewed from the front of the zigzag sewing head H, and, upon powering-ON of the embroidery sewing machine, the rotary cylinder 16 rotates to be automatically set at the initial rotational position. The above-mentioned rotational angle (hereinafter referred to also as "sewing-progressing direction angle") for orienting the embroidering material T in the desired sewing-progressing direction is represented in an absolute value with the assumption that the rotational angle when the rotary cylinder 16 is at this initial position is "0°".

At following steps S2 and S3, a calculation process corresponding to a "second calculation means or section" is performed for calculating a target rotational angle of the rotary cylinder 16 by adding or subtracting a zigzag-swinging angle to or from the sewing-progressing direction angle calculated above. Namely, at step S2, a swinging direction of the guide lever 25 for the next stitch is identified in accordance with a selected zigzag swinging pattern, and the positive or negative sign of the swinging angle is determined on the basis of the identified swinging direction of the guide lever 25. If, for example, the absolute value of the rotational angle, indicative of the above-mentioned "sewing-progressing direction angle", is a value increasing as the guide lever 25 swings rightward, then the direction in which the guide lever 25 swings rightward is a positive direction while the direction in which the guide lever 25 swings leftward is a negative direction. In this case, the positive or negative sign is added to the value of the swinging angle depending on whether the swinging direction of the guide lever 25 for the next stitch is positive or negative. Namely, the positive or negative sign is determined for the swinging angle of the rotary cylinder 16 is determined such that the swinging increases in accordance with the stitch-by-stitch zigzag swinging direction of the guide lever 25. For example, if the swinging angle is set at 30°, "+30°" is set when the guide lever 25 should swing rightward (n the positive direction), or, "−30°" is set when the guide lever 25 should swing leftward (in the negative direction). Than, at step S3, the swinging angle having the positive or negative sign added thereto at step S2 above is added to the sewing-progressing direction angle calculated at step S1, to thereby determine a target rotational angle indicative of an absolute rotational position at which the rotary cylinder 16 should be positioned prior to the needle drop of the next stitch.

At next step S4, a difference is calculated between the value of the target rotational angle determined at step S3 and the current rotational position of the rotary cylinder 16. Thus, the value of the target rotational angle determined at step S3 is converted into a relative rotational angle corresponding to the current position of the rotary cylinder 16, after which the processing of FIG. 8 is brought to an end. Upon completion of the processing of FIG. 8, the driving motor 18 of the rotary cylinder 16 is activated in accordance with the calculated relative rotational angle, to thereby rotate and position the rotary cylinder 16 at the target rotational angle. The aforementioned calculation processing is repeated per stitch during the sewing operation. The driving motor 18 of the rotary cylinder 16 may be controlled, in accordance with the of the target rotational angle determined at step S3, with the operation of step S4 omitted. Further, the operations of steps S1-S4 may be implemented by a dedicated hardware circuit constructed to perform the same rotational angle calculation processing function as set forth above, rather than the computer program.

Figure 9A:
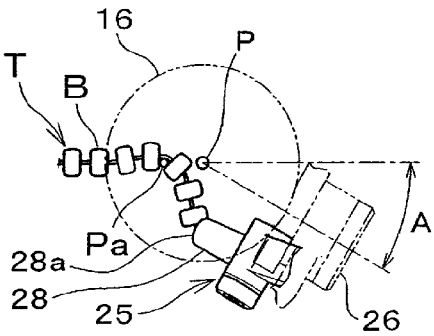
FIGS. 9A and 9B are views explanatory of behavior of the guide lever when performing zigzag sewing.
Figure 9B:
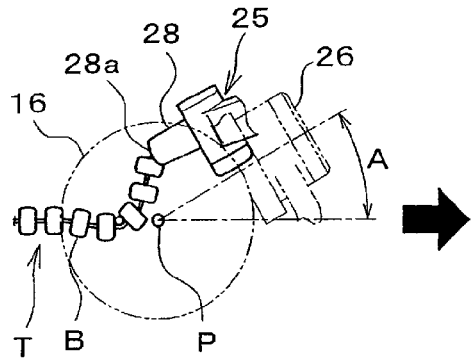

FIGS. 9A and 9B are views explanatory of the zigzag swinging performed by rotating the rotary cylinder 16 on the basis of the rotational angle calculated through the above-described operational sequence. As shown in FIG. 9A, when the guide lever 25 should swing leftward (downward in the figure) with respect to the sewing-progressing direction, the lever pin 26 is turned through an angle calculated by adding a leftward swinging angle A to a relative sewing-progress direction of the zigzag sewing head H. Further, as shown in FIG. 9B, when the guide lever 25 should swing rightward (upward in the figure) with respect to the sewing-progressing direction, the lever pin 26 is turned through an angle calculated by adding a rightward swinging angle A to a relative sewing-progress direction of the zigzag sewing head H. Thus, the embroidering material T supplied from the guide cylinder 28 is zigzagged leftward or rightward of the sewing-progressing direction by an amount of movement consisting of a combination of 1) a movement amount based on movement, in one or the other direction, of the linear swinging movement of the guide lever 25 and 2) a movement amount based on the swinging angle A provided by the rotation of the rotary cylinder 16. Therefore, the embroidering material T is zigzagged sufficiently away from the needle drop position P, so that, even where the embroidering material T has a great thickness or diameter, it is effectively possible to prevent the embroidering material T from contacting the sewing needle 8.

Figure 10:
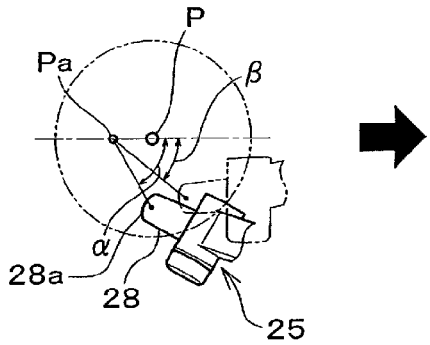
FIG. 10 is a view explanatory of behavior of the guide lever when performing zigzag sewing.

FIG. 10 is a view explanatory of behavior of the guide lever 25 when zigzag-swinging the embroidering material T in the instant embodiment. In the figure, solid lines indicate the guide lever 25 that zigzags the embroidering material T by the amount of movement consisting of the combination of the movement amount based on the linear swinging movement of the guide lever 25 (FIG. 9A) and the movement amount based on the swinging angle A provided by the rotation of the rotary cylinder 16, while two-dot-dash lines (imaginary lines) indicate the guide lever of the conventional zigzag sewing head that zigzags the embroidering material T based only on the swinging movement of the guide lever. As shown in the figure, in the case where the embroidering material T is zigzagged by the amount of movement consisting of the combination of the movement amount based on the linear swinging movement of the guide lever 25 and the movement amount based on the swinging angle A provided by the rotation of the rotary cylinder 16, the leftward/rightward (upward/downward in the figure) swinging width from the sewing progressing direction of the guide member 35 does not practically differ as compared to the case where the embroidering material is zigzagged based only on the swinging movement of the guide lever. However, because the embroidering material lead-out port 28*a* approaches the last stitch Pa by turning about the needle drop position P (axis of the needle bar), the swinging angle $\alpha$, about the last stitch Pa, of the embroidering material T is greater than the swinging angle $\beta$ in the conventional zigzag sewing head. Thus, in the instant embodiment, the embroidering material T gets far away from the needle drop position P, so that the embroidering material T can be prevented from contacting the sewing needle 8 with an increased reliability and thus it is possible to effectively prevent the beads B (see FIG. 9) and/or sewing needle 8 from being broken due to contact between the beads B and the sewing needle 8. Further, by the embroidering material lead-out port 28*a* approaching the last stitch Pa, it is possible to prevent a superfluous length of the embroidering material T from being paid out per zigzagging movement, and thus, the embroidering material T can be sewn onto the fabric with no slack.

Further, with the zigzag sewing head H employed in the instant embodiment, amounts of zigzag-swinging movement of the embroidering material T can be increased without the embroidery frame 5 being moved leftward and rightward of the sewing-progressing direction, and thus, it is possible to prevent stitches from zigzagging with respect to the sewing-progressing direction. Thus, the zigzag sewing head H employed in the instant embodiment can sew embroidering materials T of great diameters or widths onto fabrics without changing sewing designs of the embroidering materials T. Further, even where an embroidering material T of a great diameter is to be sewn, the zigzag sewing head H employed in the instant embodiment requires a rotational direction and angle of the rotary cylinder 16, instructed by sewing data, to be changed only through an angle corresponding to a swinging angle necessary for zigzagging the embroidering material T without changing the sewing data themselves; thus, the sewing operation by the zigzag sewing head H can be controlled with ease.

Figure 11:
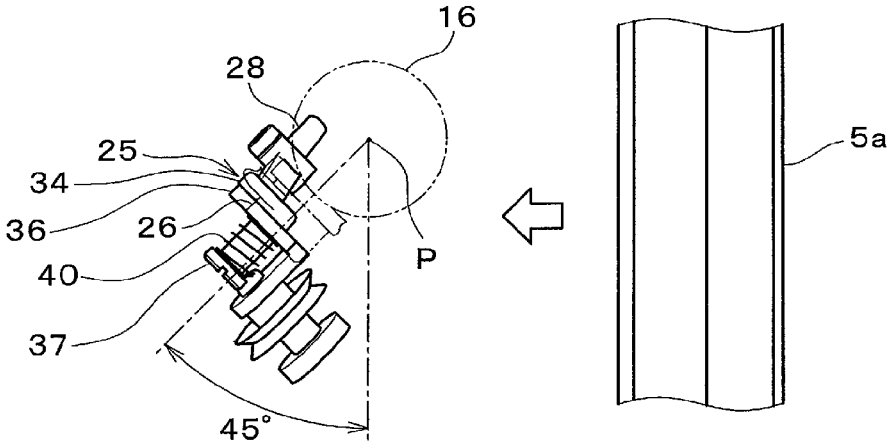
FIG. 11 is a view explanatory of rotational direction and rotational angle control of the rotary cylinder when the embroidery frame is to be moved from the zigzag sewing head to the multi-color embroidering head.
Figure 12:
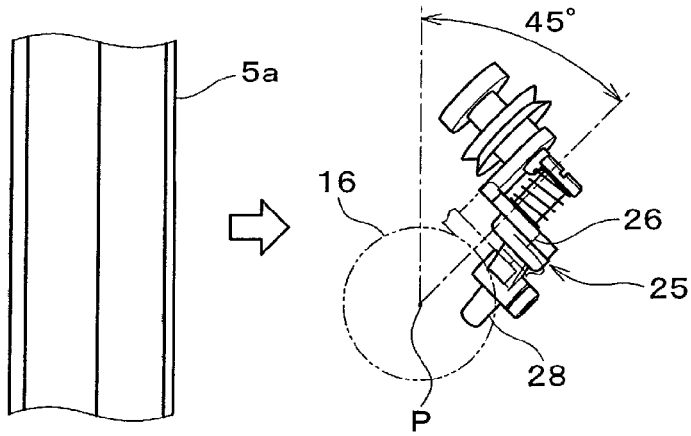
FIG. 12 is a view explanatory of rotational direction and rotational angle control of the rotary cylinder when the embroidery frame is to be moved from the multi-color embroidering head to the zigzag sewing head.

Next, a description will be given about control automatically performed for positioning the rotary cylinder 16 at a predetermined rotational angle when the embroidery frame 5 is to be subjected to needle-to-needle movement between the zigzag sewing head H and the multi-color embroidering head HH. FIGS. 11 and 12 are views explanatory of such control for positioning the rotary cylinder 16 at a predetermined rotational angle. In this case, the control is carried out in such a manner that, even when the human operator forgot to perform the manual operation for moving the guide lever 25 to the evacuated position prior to moving the embroidery frame 5 and thus the vertical side portion 5*a* of the embroidery frame 5 has interfered with the guide member 35 and/or guide cylinder 28, the guide lever 25 can be positioned at a position where the guide lever 25 is automatically moved by the guide member 35 and guide cylinder 28 being pressed by the vertical side portion 5*a* because of subsequent movement of the embroidery frame 5. The "predetermined rotational angle" at which the rotary cylinder 16 should be positioned for such a purpose is an angular position where the engagement pin 38 can be automatically disengaged from (or unlocked from) the engaging hole 39 (FIG. 7) as the moving embroidery frame 5 abuts against the guide lever 25. Namely, when the axial direction of the engagement pin 38 is at a right angle or near right angle with the moving direction of the embroidery frame 5 and if the moving embroidery frame 5 pushes a portion of the guide lever 25 including the engagement pin 38, then the engagement pin 38 hits the inner wall surface of the engaging hole 39 and is locked in the engaging hole 39. By contrast, when the axial direction of the engagement pin 38 agrees with the moving direction of the embroidery frame 6 or is at a suitable angle with the moving direction of the embroidery frame 5 and if the moving embroidery frame 5 pushes the portion of the guide lever 25 including the engagement pin 38, then the engagement pin 38 can be disengaged from, i.e. unlocked from, the engaging hole 39. More specifically, when the embroidery frame 5 is to be moved from the zigzag sewing head H to the multi-color embroidering head HH, the rotary cylinder 16 is positioned at a rotational position such that the lever pin 26 can be positioned about 45° in left front of the needle drop position P, as shown in FIG. 11. Assuming that the position where the lever pin 26 faces right is a zero degree position (initial position) as noted above, the positioning angle in FIG. 11 is about 135° clockwise from the zero degree position (initial position). When the embroidery frame 5 is to be moved from the multi-color embroidering head HH to the zigzag sewing head H, on the other hand, the rotary cylinder 16 is positioned at a rotational position such that the lever pin 26 can be positioned about 45° in right front of the needle drop position P, as shown in FIG. 12. The positioning angle in FIG. 12 is about 315° clockwise from the zero degree position (initial position). As known in the art, the rotary cylinder 16 is positioned at a predetermined rotational angle through rotational position control of the motor 18, the control is not rotational control in just one direction, and the rotational direction is also controlled so that the motor is moved from the current position in a direction closer to a predetermined target rotational angle.

Now, with reference to FIG. 11, a description will be given about how the guide lever 25 is evacuated when needle-to-needle movement of the embroidery frame 5 is to be effected from the zigzag sewing head H to the multi-head embroidering head HH. As the embroidery frame 5 moves leftward in the figure, the retaining clip 44 (see FIG. 6B) abuts against the lower end of the guide cylinder 28 which is a portion of the guide lever 25 closest to the vertical side portion 5*a* of the approaching embroidery frame 5. Then, the embroidery frame 5 further moves leftward, the guide cylinder 28 is pushed leftward, so that the connecting member 36 connected to the guide cylinder 28 is moved away from the base member 34 against the urging force of the coil spring 40. Thus, the engagement pin 38 of the connecting member 36 disengages from and thus is unlocked from the engaging hole 39, upon which the guide lever 25 including the connecting member 36 and guide member 35 is caused, by further movement of the embroidery frame 5, to pivot about the guide pin 37 toward the evacuated position. Then, once the guide lever 25 swings to a position where a gripping portion of the retaining clip 44 can pass under the guide cylinder 28, the guide lever 25 stops swinging.

By controlling the rotational direction and angle of the rotary cylinder 16 in the aforementioned manner, the guide lever 25 can be automatically moved upward, and thus safely evacuated, even when the guide member 35 and guide cylinder 28 and the vertical side portion 5*a* (retaining clip 44) of the approaching embroidery frame 5 have interfered with each other due to a human operator's failure to evacuate the guide lever 25 in advance. Thus, the instant embodiment can effectively prevent damages to the guide member 35 and guide cylinder 28. Note that, because the guide lever 25 stops swinging at the position where the gripping portion of the retaining clip 44 can pass under the guide cylinder 28 and does not move to the fall evacuated position indicated in imaginary lines of FIG. 6A, it is desirable that the guide lever 25 move to the full evacuated position by subsequent manual operation.

Whereas the preferred embodiment has been described above in relation to the case where the rotational angle of the rotary cylinder 16 is controlled such that a straight line interconnecting the needle drop position P and the lever pin 26 makes about 45° with respect to the longitudinal direction of the vertical side portion 5*a*, the rotational angle of the rotary cylinder 16 is not so limited. For example, the rotational direction and rotational angle of the rotary cylinder 16 may be controlled such that the lever pin 26 is positioned at another suitable angle than the above-mentioned, as long as the engagement between the engagement pin 38 and engaging hole 39 is terminated or canceled by the guide lever 25 being pressed by the moving embroidery frame 5 and the guide member 35 pivots about the guide pin 37 to get away from the moving area of the embroidery frame 5.

When the needle-to-needle movement of the embroidery frame 5 is to be effected from the multi-head embroidering head HH to the zigzag sewing head H, on the other hand, the rotation control of the rotary cylinder 16 may be dispensed with. This is because, in many cases, the guide member 35 has already been withdrawn to the evacuated position through the last needle-to-needle movement from the zigzag sewing head H to the multi-head embroidering head HH or replacement of the embroidery frame 5.

Second Embodiment

Figure 13:
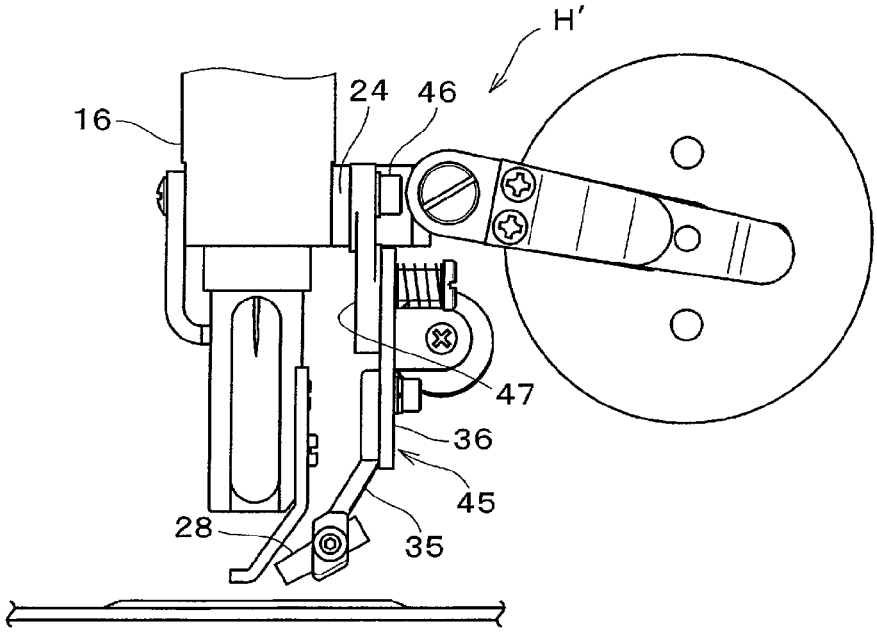
FIG. 13 is a front view of a lower section of a zigzag sewing head according to a second embodiment of the present invention.
Figure 14:
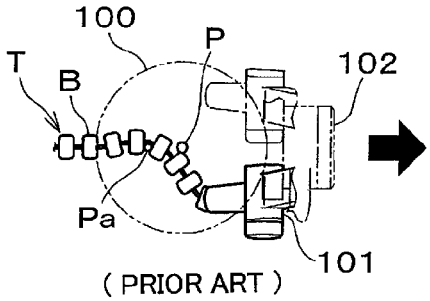
FIG. 14 is a view explanatory of a construction and behavior of a conventionally-known zigzag sewing head.
Figure 15A:
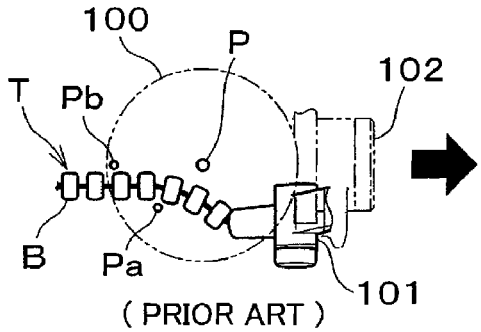
( PRIOR ART ) F I G. 1 5 A
FIGS. 15A and 15B are views explanatory of a construction and behavior of a conventionally-known zigzag sewing head.
Figure 15B:
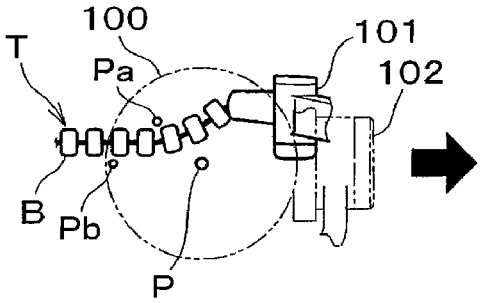
( PRIOR ART ) F I G. 1 5 B
Figure 16A:
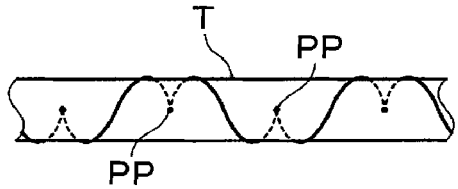
( PRIOR ART ) F I G. 1 6 A
FIGS. 16A and 16B are views showing an embroidering material sewn on a fabric by means of a conventionally-known zigzag sewing head that performs zigzag sewing operation based only on swinging movement of a guide lever.
Figure 16B:
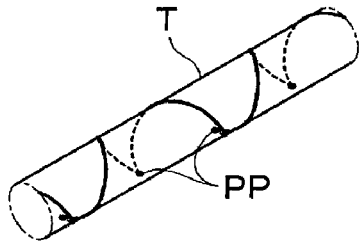
( PRIOR ART ) F I G. 1 6 B
Figure 17A:
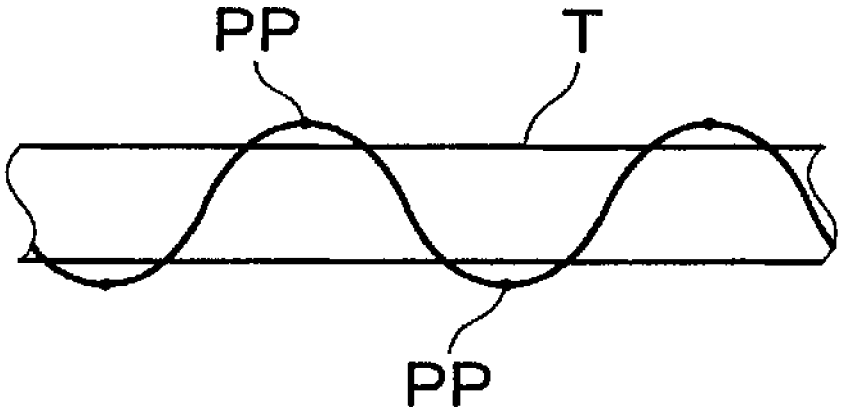
( PRIOR ART ) FIG. 17A
FIGS. 17A and 17B are views showing an embroidering material sewn on a fabric by means of a conventionally-known zigzag sewing head that performs zigzag sewing operation based on a combination of swinging movement of a guide lever and movement of an embroidery frame.
Figure 17B:
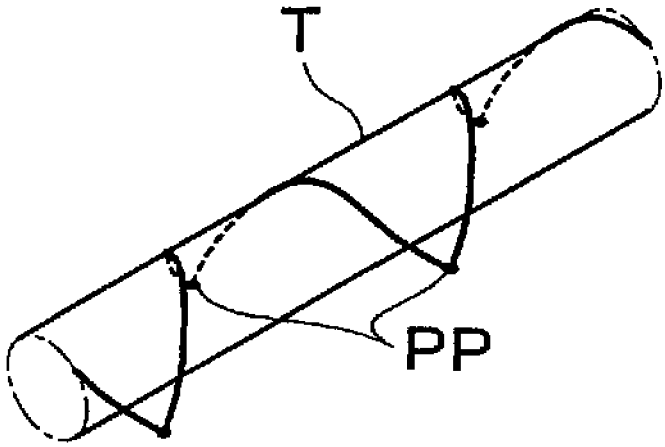
( PRIOR ART ) FIG. 17B

The following lines describe an embroidery sewing machine with zigzag sewing heads according to a second embodiment of the present invention. In figures and corresponding description of the second embodiment, the same elements as in the first embodiment are indicated by the same reference numerals and characters as in the first embodiment. FIG. 13 is a fragmentary left side view of a lower section of the zigzag sewing head H'. Guide lever (guide section) 45 provided in the zigzag sewing head H' in the second embodiment is similar in construction to the guide lever 25 in the first embodiment, only except that the guide lever 45 includes, in place of the base member 34 and lever pin 26 pivotably fastening the base member 34 to the bracket 24 in the first embodiment, a base member 47 having a different shape from that of the base member 34 and a fastening screw 46 fastening the base member 47 to the bracket 24. Namely, the base member 47 is fixed to the rotary cylinder 16 by means of the fastening screw 46 via the bracket 24. Thus, the guide lever 45 is only rotatable integrally with the rotary cylinder 16 and non-pivotable relative to the rotary cylinder 16. Further, the zigzag sewing head H' in the second embodiment is constructed to zigzag-swing the embroidering material only through control of the rotational direction and rotational angle of the rotary cylinder 16.

In the second embodiment employing the zigzag sewing head H', the rotational angle of the rotary cylinder 16 is set at a value calculated by adding or subtracting every swinging angle, necessary for zigzagging the embroidering material T leftward and rightward from the sewing-progressing direction, to or from a sewing-progressing direction angle calculated to cause the embroidering material T, which is guided via the guide lever 45 on the basis of predetermined sewing data, to be oriented in the desired sewing-progressing direction. Namely, whereas an angle to be added to the swinging direction of the guide lever 25 is used as the zigzag swinging angle for the zigzag sewing head H in the first embodiment, the zigzag-sewing swinging angle is set, for the zigzag sewing head H, in the second embodiment, such that every swinging movement, necessary for zigzagging the embroidering material T, is achievable. Operational sequence for setting a rotational angle of the rotary cylinder 16 in the second embodiment may be similar to the operational sequence of FIG. 8; however, in order to increase the swinging of the guide cylinder 28, the swinging angle value to be added or subtracted at step S3 of FIG. 8 is increased as compared to that in the first embodiment, because the guide lever 45 is non-pivotably fixed to the rotary cylinder 16 in the second embodiment. Further, in the second embodiment, a given swinging angle is always added or subtracted at step S3 of FIG. 8, in order to effect the zigzag swinging, irrespective of the thickness or diameter of the embroidering material T.

With the zigzag sewing head H' in the second embodiment, where the amount movement of the embroidering material T is adjusted only through control of the rotational direction and rotational angle of the rotary cylinder 16, the second embodiment can simplify the necessary zigzagging operation control of the zigzag sewing head. Further, because there is no need for a particular mechanism for swinging the guide lever 25 and a drive mechanism, such as the zigzagging motor 33, the second embodiment can simplify the construction of the zigzag sewing head. Furthermore, because the zigzagging is effected only by the rotation of the rotary cylinder 16, the embroidering material lead-out port 28*a* can approach the last stitch Pa (immediately preceding the current stitch) as compared to a linearly-swinging guide lever, such as the guide lever 25 provided in the zigzag sewing head H in the first embodiment. Thus, it is possible to prevent a superfluous length of the embroidering material T from being paid out per zigzagging movement, so that the embroidering material T can be sewn onto the fabric with no slack. In this way, the embodiment can achieve the advantageous result that the embroidering material T can be sewn with a greatly improved finish.

It should be appreciated that the present invention is not limited to the above-described embodiments and may be modified variously within the scope of the technical idea stated in the claims, specification and drawings. It is also important to note that any shapes, constructions and materials not directly specified in the specification and drawings are within the scope of the technical idea of the present invention as long as they can accomplish the above-described behavior and advantageous results of the present invention. For example, whereas the preferred embodiments have been described above in relation to the case where the embroidering materials T are beaded strings, any other suitable types of materials than beaded strings, such as cords and tapes, may be used as embroidering materials to be sewn onto sewing workpieces by means of the zigzag sewing heads employed in the embroidery sewing machine of the present invention. Particularly, in a case where the embroidering material T is a cord of a large diameter, use of any of the zigzag sewing heads provided in the embroidery sewing machine of the present invention can effectively avoid the sewing needle from piercing the cord.

Furthermore, whereas the preferred embodiments have been described above in relation to the combination embroidering sewing machine provided with the zigzag sewing heads H and multi-color embroidering heads HH, the basic principles of the present invention may be applied to other types of combination embroidering sewing machines, such as those provided with the zigzag sewing heads and hand-wheel-operated lock-stitching machine heads. Furthermore, the above-described zigzag sewing head H (or zigzag sewing head H'), constructed to control the rotational angle and rotational direction of the rotary cylinder 16 at the time of zigzag sewing, may be applied to embroidery sewing machines provided with only the zigzag sewing head Hs (or zigzag sewing heads H').

This application is based on, and claims priority to, JP PA 2007-152831 filed on 8 Jun. 2007. The disclosure of the priority applications, in its entirety, including the drawings, claims, and the specification thereof, is incorporated herein by reference.

What is claimed is:

1. An embroidery sewing machine comprising:

a zigzag sewing head including: a needle bar reciprocatively drivable with a sewing needle attached thereto; a rotary member provided around an outer periphery of the needle bar for rotation about an axis of the needle bar; and a guide section for guiding a string-shaped embroidering material to a sewing position;

a first calculation section for calculating, on the basis of sewing data, a sewing-progressing direction angle for rotating the rotary member to orient the embroidering material, guided by the guide section, in a sewing-progressing direction; and a second calculation section for adding or subtracting a zigzag-swinging angle to or from the sewing-progressing direction angle, calculated by said first calculation section, to thereby calculate a target rotational angle of the rotary member, wherein the rotary member is rotated in accordance with the target rotational angle calculated by said second calculation section.

2. The embroidery sewing machine as claimed in claim 1 wherein said zigzag sewing head further includes a swinging mechanism for swinging the guide section relative to said rotary member to thereby zigzag-swing the embroidering material, guided by the guide section, leftward and rightward of the sewing-progressing direction, and a swinging amount corresponding to the swinging angle of the rotary member is added to a width of zigzag-swinging, by said swinging mechanism, of the guide section.

3. The embroidery sewing machine as claimed in claim 1 wherein every swinging movement necessary for the embroidering material, guided by the guide section, to be zigzag-swung leftward and rightward of the sewing-progressing direction is set by the swinging angle added or subtracted by said second calculation section.

4. The embroidery sewing machine as claimed in claim 1 which further comprises another machine head provided in combination with said zigzag sewing head, and wherein the head to be used for sewing onto a sewing workpiece is switchable between said zigzag sewing head and said other machine head by an embroidery frame, holding the sewing workpiece, moving so as to be operatively associated with a desired one of said zigzag sewing head and said other machine head, wherein the guide section of said zigzag sewing head is movable between a sewing operation position where the guide section enters a moving area of the embroidery frame and an evacuated position upwardly away from the moving area of the embroidery frame, the guide section including a locking member for locking the guide section in the sewing operation position, and wherein, when the embroidery frame is to be subjected to needle-to-needle movement between said zigzag sewing head and said other machine head, the rotary member is positioned at a predetermined rotational angle such that, as the embroidery frame moves to abut against and press the guide section, locking by the locking member is canceled to allow the guide section to move to the evacuated position.

5. A method for controlling an embroidery sewing machine including a zigzag sewing head including: a needle bar reciprocatively drivable with a sewing needle attached thereto; a rotary member provided around an outer periphery of the needle bar for rotation about an axis of the needle bar; and a guide section for guiding a string-shaped embroidering material to a sewing position, said method comprising:

a step of calculating, on the basis of sewing data, a sewing-progressing direction angle for rotating the rotary member to orient the embroidering material, guided by the guide section, in a sewing-progressing direction; and a step of adding or subtracting a zigzag-swinging angle to or from the sewing-progressing direction angle, calculated by said step of calculating, to thereby obtain a target rotational angle of the rotary member, wherein the rotary member is rotated in accordance with the target rotational angle obtained by said step of adding or subtracting.

* * * * *